US005979560A

United States Patent [19]

Nobileau

[11] Patent Number: 5,979,560

[45] **Date of Patent: *Nov. 9, 1999**

[54] LATERAL BRANCH JUNCTION FOR WELL CASING

[76] Inventor: Philippe Nobileau, 4-40 ch du Vinaigrier, Villefranche-Corne d'Or, 06300 Nice, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,971

[22] Filed: Sep. 9, 1997

[51] Int. Cl.[6] ..... E21B 7/06

[52] U.S. Cl. ..... 166/381; 166/50; 166/117.6; 166/207; 166/242.1

[58] Field of Search ..... 166/381, 50, 117.6, 166/207, 242.1, 242.2

[56] References Cited

U.S. PATENT DOCUMENTS

| | | | |
|---|---|---|---|
| 2,397,070 | 3/1946 | Zublin | 166/50 |
| 2,797,893 | 7/1957 | McCune et al. | 166/50 |
| 5,318,122 | 6/1994 | Murray et al. | 166/313 |
| 5,330,007 | 7/1994 | Collins et al. | 166/313 |
| 5,458,209 | 10/1995 | Hayes et al. | 175/61 |
| 5,464,062 | 11/1995 | Blizzard, Jr. | 166/376 |
| 5,477,925 | 12/1995 | Trahan et al. | 166/382 |
| 5,494,106 | 2/1996 | Gueguen et al. | 166/277 |
| 5,520,252 | 5/1996 | McNair | 166/313 |
| 5,526,880 | 6/1996 | Jordan, Jr. et al. | 166/291 |
| 5,564,503 | 10/1996 | Longbottom et al. | 166/313 |
| 5,680,901 | 10/1997 | Gardes | 166/50 |
| 5,794,702 | 8/1998 | Nobileau | 166/380 |

FOREIGN PATENT DOCUMENTS

| | | |
|---|---|---|
| 0 795 679 A2 | 9/1997 | European Pat. Off. . |
| WO 99/04135 | 1/1999 | WIPO . |

*Primary Examiner*—Hoang C. Dang
*Attorney, Agent, or Firm*—James E Bradley

[57] ABSTRACT

A casing junction member connects in a well between a main casing and a lateral branch casing. The junction member has an upper end portion which connects to the main casing extending above the member. It has a lower end portion that is coaxial and connects into the main casing below the junction member. The junction member has a lateral section which joins the main section at a junction and extends downward for connecting to lateral branch casing. The junction between the main section and the lateral section has a lower perimeter portion that is generally in the shape of a parabola. A stiffening member is joined to the lower perimeter portion of this junction. The stiffening member is located in a plane containing the lower perimeter portion of the junction.

20 Claims, 3 Drawing Sheets

LATERAL BRANCH JUNCTION FOR WELL CASING

TECHNICAL FIELD

This invention relates in general to the construction of a lateral branch for a primary well and particularly to a junction member which sealingly connects the main borehole casing and the branch liner casing.

BACKGROUND ART

In recent years, well construction technology has yielded substantial increases in well productivity with the spread of horizontal drilling for the bottom end section of the well. Unfortunately horizontal drilled wells provide limited zonal isolation and do not always permit good completion practices regarding the independent production of different production zones. Research efforts are now concentrating on the possibility of drilling lateral branches either inclined or horizontal from a primary well to enhance further reservoir productivity. Also lateral branches open the potential of tapping several smaller size reservoirs spread around from one single well without the need to sidetrack and redrill the well when moving the production from one production zone to the next. The challenge with multilateral completion is to install a junction apparatus having adequate internal and external pressure capability without relying only on the strength of the local rock formations.

Prior art junction apparatus designs are based on a low angle side branch casing connected to a window on the main borehole casing. Prior proposals generally require in situ milling of a window or a section in the main borehole casing. Milling steel casing downhole is a difficult task. Also, while there are numerous proposals for sealing the branch liner casing to the window, improvements are needed. One design deforms a complete junction assembly to offer a diameter equal or less than the diameter of the main borehole casing and expanding it in situ to the full cylindrical shape. In that design, the junction assembly may be elastomeric or memory metal. The junction assembly is expanded within an enlarged section of the well formed after a section of the casing is milled out.

Due to the side window based connecting link between the main borehole casing and the branch outlet, all these configurations offer poor internal pressure capacity and even more limited collapse capability when the junction is located in unconsolidated or weakly consolidated formations. The poor internal pressure capability and resistance to collapsing exists even when they are fully cemented since cement does not work well in traction. It is therefore highly desirable to have a junction apparatus offering good internal pressure and collapse capability to permit a wide freedom in the location of lateral junction independent from the strength of the cementing job and/or surrounding rock formation.

DISCLOSURE TO INVENTION

In this invention, a casing junction member or apparatus is provided which an upper end which connects into the main casing. A lower main end connects to the lower main casing extending into the well. The junction apparatus has a lateral branch section which is at an angle relative to the longitudinal axis of the main section.

The lateral and main sections join each other at a junction which has a lower perimeter portion that is generally in the shape of parabola. A stiffening plate or rib is located at this junction. The plate is located in a plane of the perimeter portion and is joined between the lateral and main sections.

In the preferred method of installation, the junction apparatus is of steel and is plastically deformable from a collapsed position to a set position. In the collapsed position, the junction apparatus has a diameter no greater than the main casing. The main bore is drilled and underreamed at an intersection depth. The junction apparatus is connected to the main casing and lowered into the well with the main casing. After reaching the underreamed section, pressure is applied to the main casing to cause the junction apparatus to move to the set configuration. Then the main casing is cemented in place, with the cement also flowing around the junction apparatus in the underreamed section of the borehole. Subsequently, the lateral bore is drilled and a lateral casing liner installed and sealed to the lateral section of the junction member.

Preferably the junction apparatus has an intermediate portion which is conical and joins the upper end portion of the main section. The conical intermediate portion diverges in a downward direction. A conical main portion joins the lower end of the intermediate portion and extends downward to the lower end portion of the main section. The conical main portion diverges in a downward direction. A generally conical lateral portion joins the intermediate portion also and extends downward to the lower end portion of the lateral section. The conical lateral portion also converges in a downward direction. The conical main and lateral portions are truncated only their inner sides and join each other at the junction.

BEST MODE FOR CARRYING OUT THE INVENTION

Figure 1:
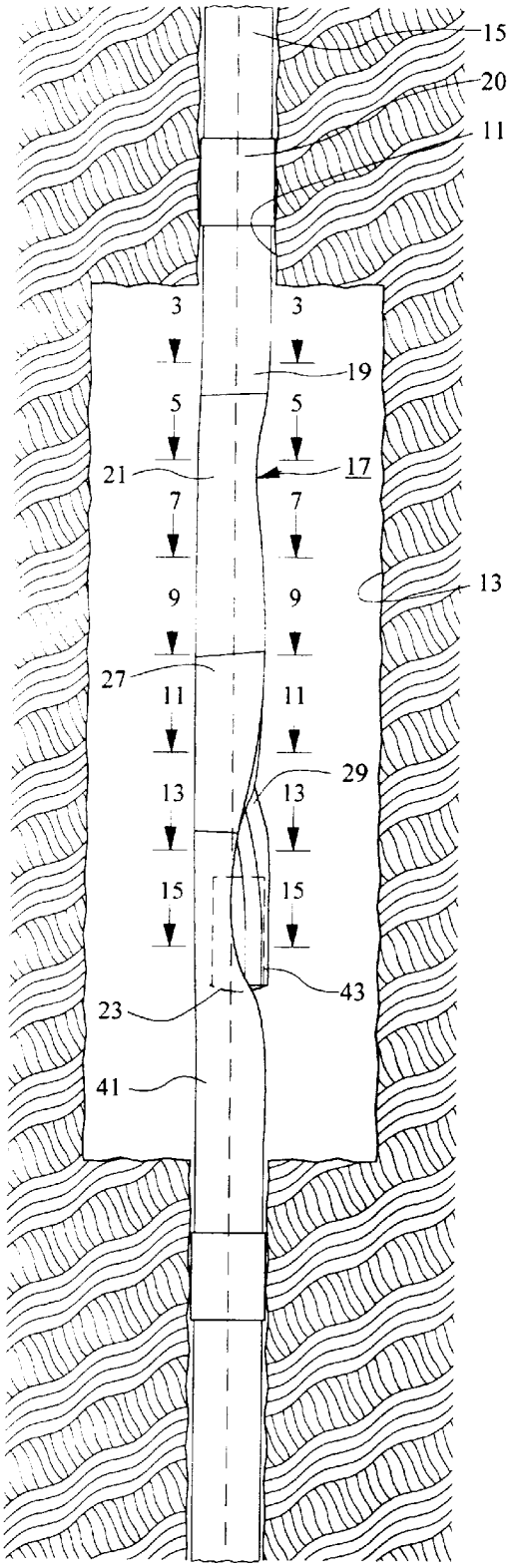
FIG. 1 is a side elevational view illustrating a junction apparatus connected into a main string of casing and shown in a collapsed position.

Referring to FIG. 1, a main bore 11 has been drilled. At a desired intersection depth, an enlarged diameter section 13 is created by underreaming. A string of main casing 15 has been run into main bore 11 through enlarged section 13. Enlarged section 13 is created at a desired intersection depth to start a lateral branch bore.

Figure 2:
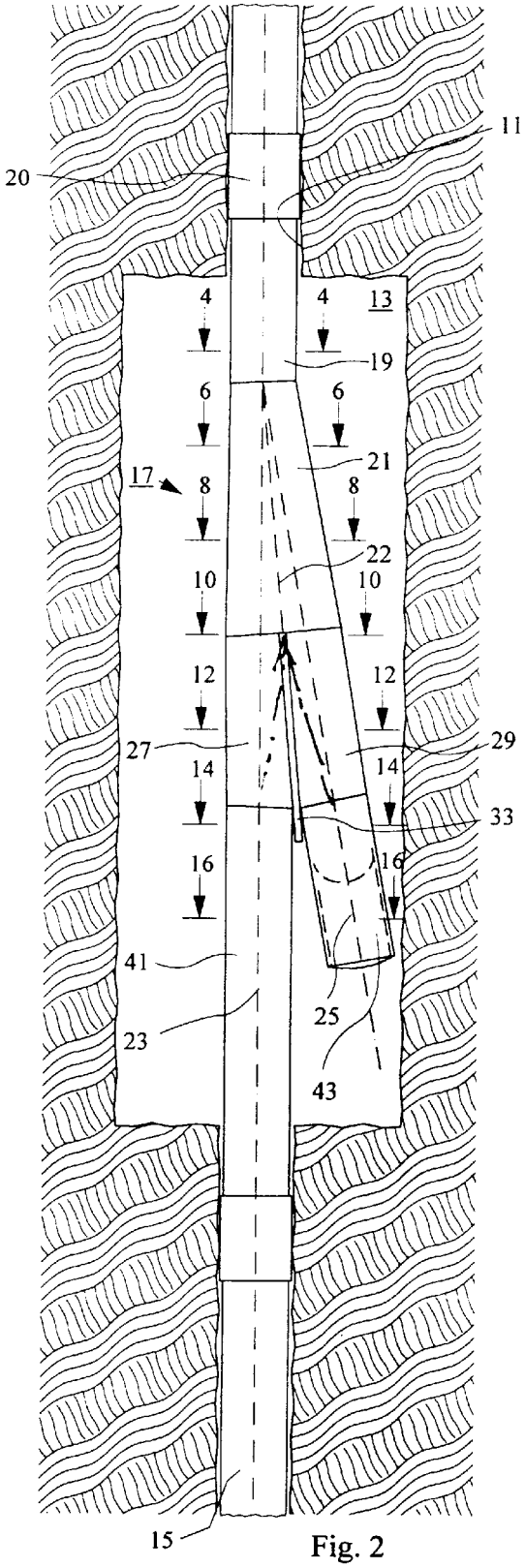
FIG. 2 is a side elevational view similar to FIG. 1, but showing the junction apparatus expanded to a set position.
Figure 3:
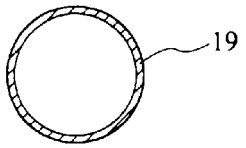
FIG. 3 is a sectional view of the junction apparatus of FIG. 1, taken along the line 3—3 of FIG. 1.
Figure 4:
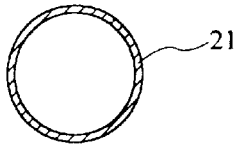
FIG. 4 is a sectional view similar to FIG. 3, but taken along the line 4—4 of FIG. 2 to show the apparatus in the set position.
Figure 5:
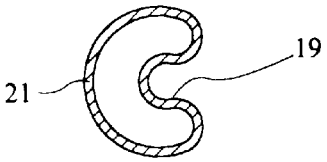
FIG. 5 is a sectional view of the junction apparatus of FIG. 1, taken along the line 5—5 of FIG. 1.

A junction member 17 is connected into main casing 15 at the surface and lowered into enlarged section 13 while running casing 15. Junction member 17 is in a collapsed position while running in, as shown in FIG. 1. Subsequently, it will be expanded by internal pressure to set position in FIG. 2. Junction member 17 is of steel of a high elongation grade which is capable of being plastically deformed into the collapsed position and expanded under fluid pressure to the set position.

Figure 6:
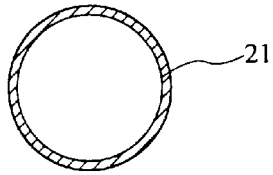
FIG. 6 is a sectional view similar to FIG. 5, but taken along the line 6—6 of FIG. 2 to show the apparatus in the set position.
Figure 7:
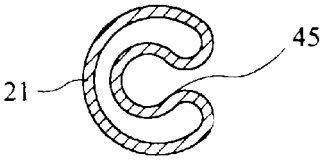
FIG. 7 is a sectional view of the junction apparatus of FIG. 1, taken along the line 7—7 of FIG. 1.
Figure 8:
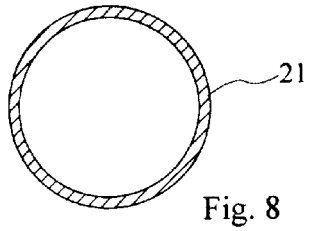
FIG. 8 is a sectional view similar to FIG. 7, but taken along the line 8—8 of FIG. 2 to show the apparatus in the set position.
Figure 9:
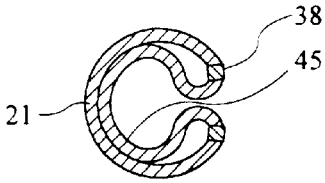
FIG. 9 is a sectional view of the junction apparatus of FIG. 1, taken along the line 9—9 of FIG. 1.

Junction member 17 includes an upper end portion 19 which is secured to a casing collar 20 of main casing 15. Upper end portion 19 is a cylindrical section which is coaxial with a main bore axis 23. An intermediate portion 21 is joined to upper end portion 19, preferably by welding. Intermediate portion 21 is a conical member which diverges or increases in diameter in downward direction, as can be seen by comparing FIGS. 6 and 8 and viewing FIGS. 18 and 19. Intermediate portion 21 is a circular cone generated about an axis 22. Cone axis 22 intersects and is inclined at a slight angle relative to main bore axis 23. Similarly, a lateral branch axis 25 is inclined slightly and intersects main bore axis 23 at the same point of intersection as cone axis 22. Cone axis 22 is one-half the angle of intersection of lateral axis 25. The angles of intersections may differ from well to well, and in the embodiment shown, lateral axis 25 is at a 10° angle relative to main axis 23, while cone axis 22 is at a 5° angle. The upper portion of the lateral branch wellbore (not shown) will be drilled at lateral axis 25.

A main conical portion 27 joins the lower end of intermediate section 21, such as by welding. Main conical portion 27 is also a circular cone that is slightly tilted relative to main axis 23. Main conical portion 27 is generated about an axis 28, shown in FIG. 17. When viewed in the elevational view of FIG. 2, the left side of the conical intermediate portion 21 and main portion 27 appear flush with each other and in a straight line with a side of main casing 15. Main conical portion 27 diverges in a downward direction, having a decreasing diameter as shown in FIGS. 18 and 19.

A lateral conical portion 29, identical to main conical portion 27, also joins intermediate portion 21, such as by welding. Lateral conical portion 29 is also a portion of circular cone which is tilted relative to main axis 23 and lateral axis 25. Lateral conical portion 29 is generated about an axis 30 which intersects aixs 28 at intermediate portion axis 22. The point of intersection is at the lower edge of intermediate portion 21. When viewed in the elevational view of FIG. 2, a right side portion of lateral conical portion 29 appears flush with a right side portion of intermediate portion 21 and parallel to lateral axis 25. Lateral conical portion 29 also diverges in a downward direction, having a decreasing diameter as shown in FIG. 18.

Figure 17:
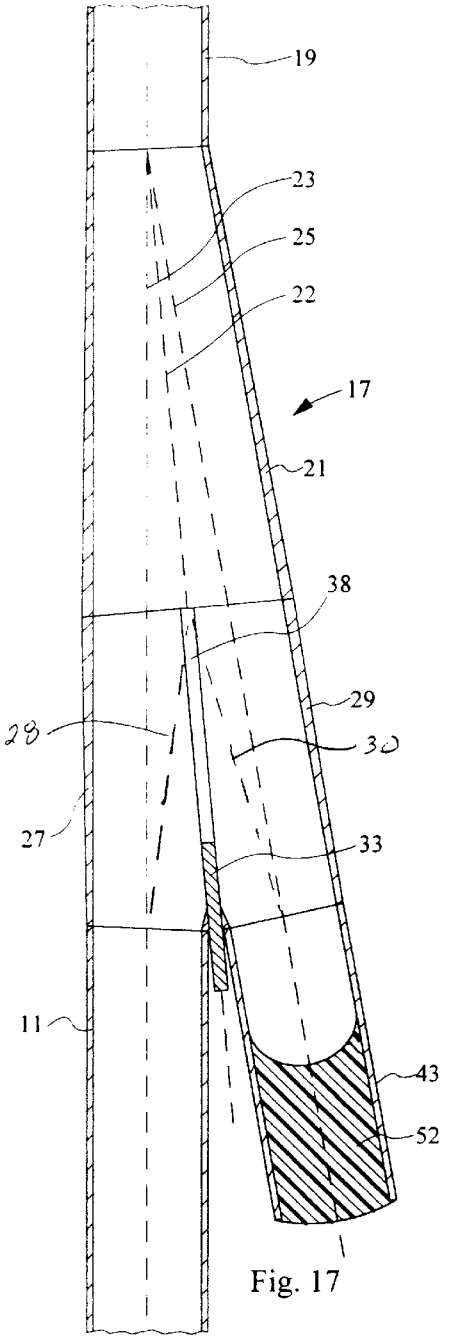
FIG. 17 is an enlarged vertical sectional view of the junction apparatus of FIG. 1, shown in the set position.
Figure 18:
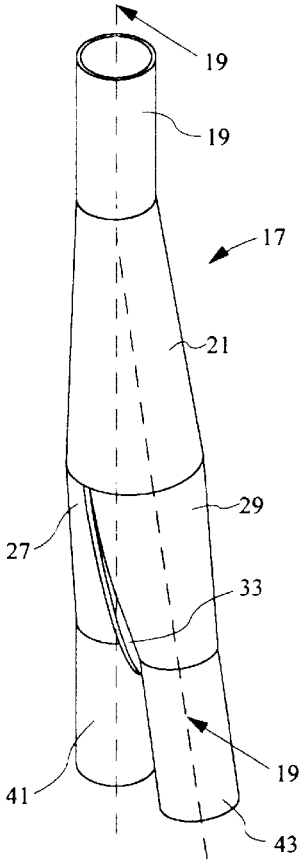
FIG. 18 is a perspective view of the junction apparatus of FIG. 1.
Figure 19:
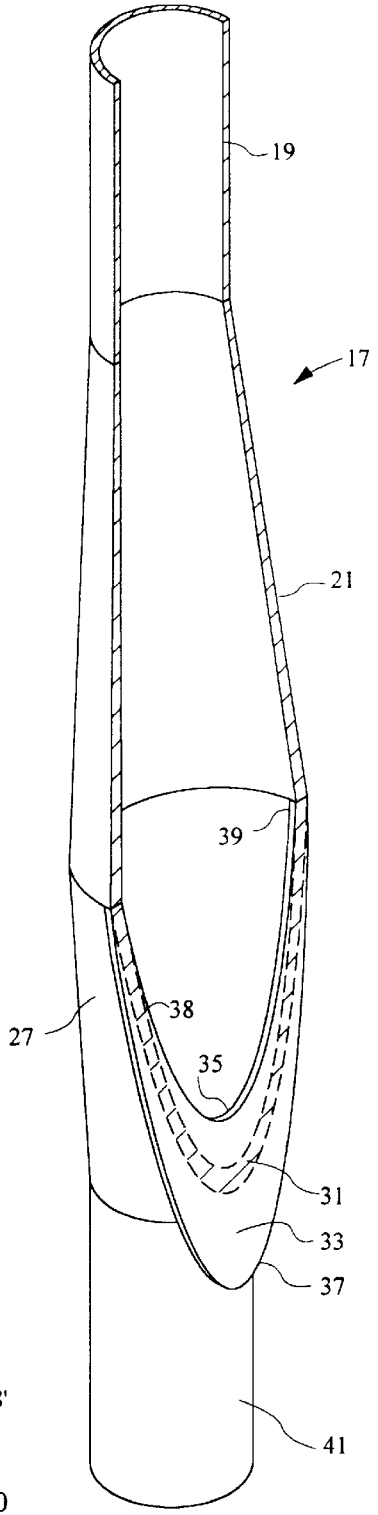
FIG. 19 is a sectional view of the junction apparatus of FIG. 1, taken along the line 19—19 of FIG. 18.

Referring to FIGS. 17–19, inner side portions of main conical portion 27 and lateral conical portion 29 are cut or truncated to form a junction of the two portions. This junction has a lower perimeter portion 31 that is in a configuration of a parabola. Lower perimeter portion 31 comprises mating edges of main and lateral conical portion 27, 29, the edges being abutable with each other. Lower perimeter portion 31 is contained in a plane that contains cone axis 22.

A stiffening plate or rib 33 is sandwiched between the conical main and lateral portions 27, 29 at lower perimeter portion 31. Stiffening plate 33 is also in the general configuration of a parabola. In the embodiment shown, it has an inner edge 35 that is in the configuration of a parabola. Outer edge 37 is also in the configuration of a parabola. However, the parabola of inner edge 35 is not as steep, with edges 35, 37 converging toward each other in an upward direction. This results in legs 38 for stiffening plate 33 that decrease in width in an upward direction until reaching a minimum width at upper ends 39. Upper ends 39 of stiffening plate 33 are located at the lower end of intermediate section 21. The width between inner edge 35 and outer edge 37 is the smallest at this point. The maximum width of plate 33 is at its lowest point.

Stiffening plate 33 is welded to main and lateral conical members 27, 29 at junction 31. In this position, inner edge 35 is located above lower perimeter portion 31, while outer edge 27 is located below lower perimeter portion 31. Stiffening plate 33 is located in a plane of lower perimeter portion 31. Conical axis 22 is contained within the plane of stiffening plate 33.

Figure 10:
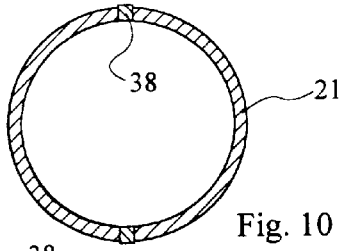
FIG. 10 is a sectional view similar to FIG. 9, but taken along the line 10—10 of FIG. 2 to show the junction apparatus in the set position.
Figure 12:
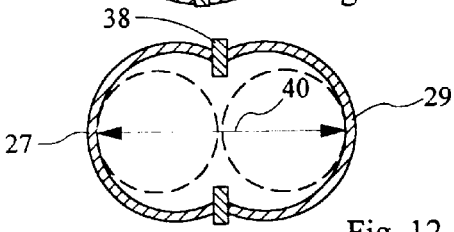
FIG. 12 is a view similar to FIG. 11, but taken along the line 12—12 of FIG. 2 to show the junction apparatus in the set position.

The purpose of stiffening plate 33 is to reinforce the junction between main and lateral conical portions 27, 29. Referring to FIGS. 10 and 12, internal pressure within junction member 17 will tend to cause junction member 17 to assume a circular configuration. The circular configuration is desired at the lower edge of intermediate portion 21 as shown in FIG. 10. However, the junction of the main and lateral conical portions 27, 29 with intermediate portion 21 is not circular, as shown in FIG. 12. In FIG. 12, which is a section taken about halfway down the joined main and lateral conical portions 27, 29, the joined conical portions will have a cross-sectional configuration that is not circular. Rather, the distance 40 between outer sides of the main and lateral conical portions 27, 29 perpendicular to a line extending between legs 38 is substantially greater than the distance between the two legs 38 of stiffening plate 33 at that point. The cross-section presents a general peanut shape, with the dotted lines in FIG. 12 representing the full bore access to the lower ends of the main and lateral branches. Without stiffening plate 33, internal pressure would tend to force the small dimension portion between legs 38 apart to the circular configuration as in FIG. 10. This would deform the junction and restrict the full bore access to both branches. Stiffening plate 33 prevents such occurrence at test pressure levels.

Referring again to FIG. 2, a cylindrical main section lower end 41 joins the lower end of main conical portion 27, which is circular at that point. The main section lower end 41 is secured to the lower continuation of main casing 15 by a threaded collar. Lower end 41 is coaxial with main axis 23. Similarly, cylindrical lateral end portion 43 joins the lower end of lateral conical portion 29, which is circular at that point. Lateral section 43 extends downward and provides a guide for drilling a lateral branch borehole (not shown). Lateral end portion 43 is coaxial with lateral axis 25. Stiffening plate 33 extends downward a short distance between main section lower end 41 and lateral section lower end 43.

Junction member 17, constructed and tested in the set configuration will then be deformed into the collapsed configuration that is shown in FIG. 1. In the collapsed configuration, the overall diameter is substantially the same as the diameter of main casing 15 and no greater than the outer diameter of casing collar 20. Referring to FIG. 1 and FIGS. 3, 5, 7, 9, 11, 13 and 15, the collapsed configuration has a doubled back portion 45 within intermediate section 21. Doubled back portion 45 increases in extent in a downward direction as shown by comparing FIG. 5, FIG. 7 and FIG. 9.

Figure 11:
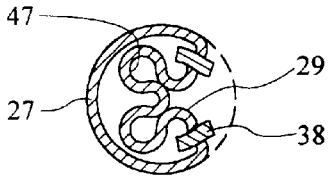
FIG. 11 is a sectional view of the junction apparatus of FIG. 1, taken along the line 11—11 of FIG. 1.
Figure 13:
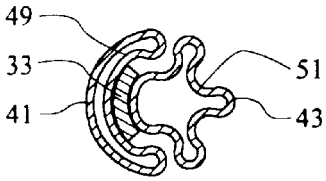
FIG. 13 is a sectional view of the junction apparatus of FIG. 1, taken along the line 13—13 of FIG. 1.
Figure 14:
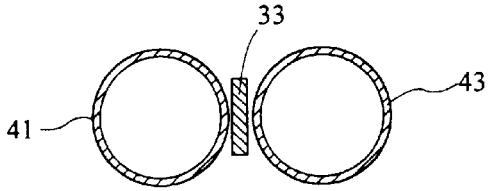
FIG. 14 is a sectional view similar to FIG. 13, but taken along the line 14—14 of FIG. 2 to show the junction apparatus in the set position.
Figure 15:
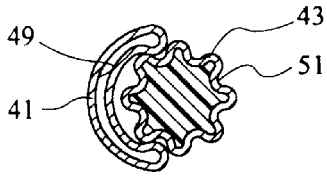
FIG. 15 is a sectional view of the junction apparatus of FIG. 1, taken along the line 15—15 of FIG. 1.
Figure 16:
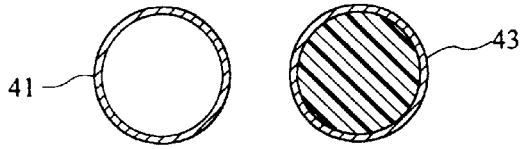
FIG. 16 is a sectional view similar to FIG. 15, but taken along the line 16—16 of FIG. 2 to show the junction apparatus in the set position.

As shown in FIG. 11, main conical portion 27 remains generally undeflected. However, lateral conical portion 29 is folded into the interior of main conical portion 27. In the position shown, two loops 47 are employed to accommodate the full extent. Note that legs 38 will not be in a common plane in the collapsed position. In FIG. 13, an inner side 49 of main lower end 41 is doubled back into an outer side portion of main lower end 41, presenting a crescent shape. A plurality of axially extending channels 51 are formed in the upper portion of lateral section lower end 43. Stiffening plate 33 is bent into a concave configuration at its lower portion. Referring to FIG. 15, more vertical channels 51 will be present and they will be symmetrical to form a corrugated configuration for lateral section lower end 43. The crescent configuration remains for main section lower end 41 for a short distance downward where it again returns to a cylindrical configuration as shown in FIG. 1. In the collapsed position, lateral end section 43 extends downward generally parallel with main axis 23.

In operation, main bore 11 will be drilled, then one or several enlarged sections 13 are created. The operator inserts one or several junction members 17 into main casing 15 while in the collapsed position and runs main casing 15. Main casing 15 will have a conventional cementing shoe (not shown) on its lower end. The cement shoe will be of a type which prevents downward flow until a dart or ball is dropped to shift a valve member. Lateral end 43 has a plug 52 which seals both while lateral end 43 is in the corrugated shape and in the set position.

When junction member 17 reaches enlarged bore section 13, the operator will apply pressure to casing 15. The internal pressure causes junction member 17 to plastically deform from the collapsed position shown in FIG. 1 to the set position shown in FIG. 2. The operator then drops a ball or dart to shift cement shoe to a position wherein fluid may be pumped downward in main casing 15. The operator then pumps cement down main casing 15, which flows out the cement shoe and back up an annulus in main bore 11 surrounding main casing 15. The cement will flow through the enlarged section 13 and up toward the surface. Drilling fluid will be pumped down behind the cement to flush main bore casing 15 of cement. A cement plug (not shown) separates the cement from the drilling fluid, the plug moving downward through junction member 17 to the lower end of main bore casing 15.

The operator may then perform further drilling through main casing 15. When the operator wishes to drill the lateral branch, he will either install a whipstock in main borehole or use a kick-out device to deflect the drill bit over into the lateral section. The operator drills out plug 52 and continues drilling at lateral angle 25 for a selected distance into the earth formation. Once a desired depth has been reached for the lateral branch, the operator will run a liner casing (not shown). The liner casing will have a conventional hanger and seal for hanging and sealing within lateral section lower end 43. The lateral liner casing will be cemented in a conventional manner.

Figure 20:
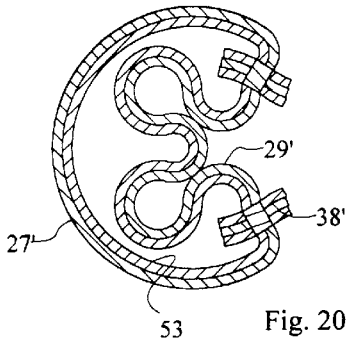
FIG. 20 is a sectional view similar to FIG. 11, but showing an alternate embodiment of the junction apparatus.

FIG. 20 illustrates an alternate embodiment in which the walls of the junction apparatus are formed with multiple plies, each being metal, to facilitate expansion from the collapsed position to the set position. For example, FIG. 20 shows an inner wall or ply 53 located within an outer ply or wall of conical members 27' and 29'. The stiffening plate is also formed of multiple plies as indicated by legs 38'. The total thickness of the two plies should be substantially no greater than that of a single wall which has the same pressure rating. The use of two walls for the various components of junction member 17 reduces the amount of strain that would otherwise occur during plastic deformation with a single wall having the same total thickness as the two plies.

The invention has significant advantages. The junction apparatus provides a good seal between the main branch casing and the lateral branch casing. The junction member may be run in collapsed and expanded to a set position. The stiffening rib provides strength to withstand internal pressure as well as external pressure without substantial deformation. The method of running the junction member in with the main casing avoids a need to mill out a window or section of the main casing.

While the invention has been shown in only one of its forms, it should be apparent to those skilled in the art that it is not so limited, but is susceptible to various changes without departing from the scope of the invention. For instance the cones can be replaced by an extended stiffening plate. Also the bottom of intermediate section can be large enough to accommodate full access to both branches side by side and the stiffening plate inner edge can be straight without any legs.

I claim:

1. A casing junction apparatus for connection in a well between a main casing and a lateral branch casing, comprising:

a main section having an upper end portion for connection to main casing extending above the apparatus, the upper end portion being cylindrical and having a longitudinal axis;

the main section having a cylindrical lower end portion substantially coaxial with the upper end portion for connection to main casing extending below the apparatus;

a lateral section which joins the main section at a junction and extends downward from the main section at an acute angle relative to the longitudinal axis, the lateral section having a cylindrical lower end portion for connection to lateral branch casing;

the junction between the main section and the lateral section having a lower perimeter portion that is generally in the shape of a parabola; and a stiffening member joined to the lower perimeter portion of the junction, the stiffening member being located in a plane containing the lower perimeter portion of the junction.

2. The apparatus according to claim 1 wherein the stiffening member is welded to the lower perimeter portion and to the main section and the lateral section.

3. The apparatus according to claim 1, wherein the apparatus further comprises:

a generally conical intermediate portion which joins the upper end portion of the main section and diverges in a downward direction; wherein the main section comprises:

a generally conical main portion which joins the intermediate portion and extends downward to the lower end portion of the main section, the conical main portion converging in a downward direction; and wherein the lateral section comprises:

a generally conical lateral portion which joins the intermediate portion and extends downward to the lower end portion of the lateral section, the conical lateral portion converging in a downward direction.

4. The apparatus according to claim 1, wherein the apparatus is movable from a collapsed position to an expanded position by application of internal fluid pressure, and wherein while in the collapsed position, the main section deforms into a doubled back configuration to receive the stiffening member and the lateral section, the lateral section generally aligning with the longitudinal axis.

5. The apparatus according to claim 4, wherein at least one of the main, the lateral sections, and the stiffening members has multiple metal walls.

6. The apparatus according to claim 1, wherein the stiffening member has an outer edge and an inner edge, the inner edge having a lower portion located above the lower perimeter portion of the junction, and the outer edge having a lower portion located below of the lower perimeter portion of the junction.

7. The apparatus according to claim 1, wherein the stiffening member has an outer edge and an inner edge which define a configuration for the stiffening member that is generally a parabola.

8. The apparatus according to claim 1, wherein the stiffening member has an outer edge and an inner edge, both of the edges of the stiffening member being generally shaped as a parabola, defining upward extending legs; and wherein the width of the stiffening member between the inner edge and the outer edge of the stiffening member is greater at a lower portion of the stiffening member than at upper ends of the legs of the stiffening member.

9. A casing junction apparatus for connection in a well between a main casing and a lateral branch casing, comprising:

a main upper end portion for connection to the main casing above the apparatus, the main upper end portion being cylindrical and having a longitudinal main axis;

a generally conical intermediate portion which joins the main upper end portion and diverges in a downward direction;

a generally conical main portion which joins the intermediate portion and extends downward, the conical main portion converging in a downward direction;

a main lower end portion for connection to the main casing below the apparatus, the main lower end portion being cylindrical and coaxial with the main axis;

a generally conical lateral portion which joins the intermediate portion adjacent to the conical main portion and extends downward at an acute angle relative to the main axis, the conical lateral portion converging in a downward direction;

a cylindrical lateral lower end portion for connection to the lateral branch casing;

the conical lateral portion joining the conical main portion at a junction which has a lower perimeter portion that is generally in the shape of a parabola; and a stiffening member joined to the lower perimeter portion of the junction, the stiffening member being located in a plane containing the lower perimeter portion of the junction.

10. The apparatus according to claim 9 wherein the stiffening member is welded to the lower perimeter portion and to the main conical portion and the lateral conical portion.

11. The apparatus according to claim 9, wherein the apparatus is movable from a collapsed position to an expanded position by application of internal fluid pressure, and wherein while in the collapsed position, the intermediate portion, main conical portion, and main lower end portion deform into a doubled back configuration to receive the conical lateral portion, the lateral lower end portion and the stiffening member, the lateral lower end portion generally aligning with the main axis.

12. The apparatus according to claim 11, wherein the conical main portion and the conical lateral portion have metal walls formed of at least two plies.

13. The apparatus according to claim 11, wherein the intermediate portion, the conical main and lateral portions, the main and lateral lower ends, and the stiffening member are formed of metal walls having multiple plies.

14. The apparatus according to claim 9, wherein the stiffening member has an outer edge and an inner edge, the inner edge having a lower portion located above the lower perimeter portion of the junction, and the outer edge having a lower portion located below the lower perimeter portion of the junction.

15. The apparatus according to claim 9, wherein the stiffening member has an outer edge and an inner edge which define a configuration for the stiffening member that is generally in the shape of a parabola having two upward extending legs.

16. The apparatus according to claim 9, wherein the stiffening member has an outer edge and an inner edge, both of the edges of the stiffening member being generally in the shape of a parabola, defining two upward extending legs; and wherein the width of the stiffening member between the inner edge and the outer edge of the stiffening member is greater at a lower portion of the stiffening member than at upper portions of the legs.

17. A method for providing a pressure resistant junction in a well between a main casing and a lateral branch casing, comprising:

providing a junction apparatus which comprises:

a main section having an upper end portion with a longitudinal main axis, a lower end portion substantially coaxial with the upper end portion;

a lateral section which joins the main section at a junction and extends downward from the main section at an acute angle relative to the main axis, the lateral section having a lower end portion;

the junction between the main section and the lateral section having a lower perimeter portion that is generally in the shape of a parabola; and a stiffening member joined to the lower perimeter portion of the junction, the stiffening member being located in a plane containing the lower perimeter portion of the junction; then connecting the upper end portion of the main section to main casing extending upward in the well from the junction apparatus and the lower end portion of the main section to main casing extending downward in the well from the junction apparatus; and connecting the lower end portion of the lateral section to lateral branch casing.

18. The method according to claim 17, further comprising pumping a cement slurry in a clearance space surrounding the junction apparatus.

19. The method according to claim 17 further comprising prior to positioning the junction apparatus in the well, collapsing the apparatus into a collapsed configuration with the main section generally doubled back, the lateral section folded against the main section with the lower end portion of the lateral section generally parallel with the main axis; and while at the desired depth, deforming the junction apparatus to a set position by pumping fluid pressure to an interior of the junction apparatus, wherein while in the set position, the upper and lower end portions of the main section will be cylindrical and the lower end portion of the lateral section at the acute angle relative to the longitudinal axis.

20. The method according to claim 19, further comprising:

prior to installing the main casing and the junction apparatus in the well, enlarging an intersection portion of the well; then connecting the junction apparatus into the main casing and lowering the main casing with the junction apparatus into the well while the junction apparatus is in the collapsed position; then performing the step of deforming the junction apparatus to the set position once the junction apparatus is in the intersection portion of the well; then pumping a cement slurry down the main casing and back up an annulus surrounding the main casing and around the junction apparatus; then drilling a lateral branch wellbore through the junction apparatus; and then performing the step of connecting the lower end portion of the lateral section to the lateral branch casing.

* * * * *